US011835905B2

(12) United States Patent
Moteki

(10) Patent No.: US 11,835,905 B2
(45) Date of Patent: Dec. 5, 2023

(54) IMAGE FORMING APPARATUS

(71) Applicant: CANON KABUSHIKI KAISHA, Tokyo (JP)

(72) Inventor: Junichi Moteki, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/981,517

(22) Filed: Nov. 7, 2022

(65) Prior Publication Data

US 2023/0152742 A1 May 18, 2023

(30) Foreign Application Priority Data

Nov. 12, 2021 (JP) ..... 2021-184629

(51) Int. Cl.
*G03G 15/00* (2006.01)

(52) U.S. Cl.
CPC ..... *G03G 15/6573* (2013.01); *G03G 2215/00417* (2013.01); *G03G 2215/00561* (2013.01); *G03G 2215/00616* (2013.01); *G03G 2215/00721* (2013.01)

(58) Field of Classification Search
CPC ..... G03G 2215/00417; G03G 15/6573; G03G 2215/00731; G03G 2215/00616; G03G 15/657; G03G 2215/2045; G03G 2215/00561
See application file for complete search history.

(56) References Cited

U.S. PATENT DOCUMENTS 10,423,098 B2 * 9/2019 Sato ..... G03G 15/5029
2019/0092592 A1 * 3/2019 Suzuki ..... B65H 5/068

FOREIGN PATENT DOCUMENTS

JP 2007233372 A * 9/2007 ..... G03G 15/657
JP 2007233372 A 9/2007
JP 2017207648 A * 11/2017

* cited by examiner

*Primary Examiner* — Jennifer Bahls
(74) *Attorney, Agent, or Firm* — ROSSI, KIMMS & McDOWELL LLP

(57) ABSTRACT

A loop detection unit including a first contact portion in contact with a back surface of the recording material. A residual sheet detection unit including a second contact portion that is configured to come into contact with the back surface of the recording material. The first contact portion and the second contact portion are configured to rotate on the same rotation shaft. The second contact portion is configured to come into contact with the back surface of the recording material on a downstream of the first contact portion in the conveyance direction of the recording material.

7 Claims, 8 Drawing Sheets

IMAGE FORMING APPARATUS

BACKGROUND OF THE INVENTION

Field of the Invention

The present invention relates to an image forming apparatus such as a copying machine, a printer, a facsimile, and a multifunction peripheral having a plurality of functions thereof.

Description of the Related Art

In an image forming apparatus, an image formed on an image bearing member such as a photosensitive drum or an intermediate transfer belt is transferred to a sheet in a transfer portion, the sheet to which the image has been transferred is conveyed to a fixing device, and the image is fixed to the sheet. At this time, a loop is formed on the sheet so that the sheet is not pulled between the transfer portion and the fixing device, and the loop is detected by a sensor to control the sheet conveyance speed of the transfer portion and the fixing device (see JP 2007-233372 A). In addition, JP 2007-233372 A discloses that a sheet remaining in a fixing device is detected by a loop detection unit for detecting a loop.

As described above, in the case of the configuration described in JP 2007-233372 A, the loop detection unit also detects the residual sheet, but in order to detect the small-sized sheet, it is required to bring the contact portion of the loop detection unit, which is contact with the sheet, close to the inlet of the nip portion of the fixing device as much as possible. On the other hand, in the loop detection, since the deformation amount of the sheet is detected, it is required to bring the contact portion into contact with the sheet on the upstream of the position where the residual sheet detection is performed.

Therefore, it is conceivable to provide the contact portions for performing the loop detection and the residual sheet detection independently of each other. However, although the contact portions are biased toward the sheet in order to detect the sheet, when each contact portion is biased by separate biasing units, the following problem may occur. For example, when the stiffness of the sheet is low, the sheet is pressed from the two contact portions by the biasing forces of the biasing units, and thus the sheet may be deformed. In addition, in a case where the weight of the sheet is small, the contact portion is pressed by the sheet and hardly moves, and thus, there is a possibility that detection by the sensor cannot be performed.

SUMMARY OF THE INVENTION

The present invention provides a configuration capable of improving detection accuracy of each of loop detection and residual sheet detection.

According to one aspect of the present invention, an image forming apparatus includes a transfer portion configured to transfer a toner image onto a recording material, a first rotary member configured to rotate and include a heat source, a second rotary member configured to form a nip portion by being in contact with an outer peripheral surface of the first rotary member, and fix a toner image by applying heat and pressure while nipping and conveying a recording material together with the first rotary member, a loop detection unit configured to detect that a recording material is looped between the nip portion and the transfer portion in a conveyance direction of the recording material, the loop detection unit including a first contact portion in contact with a back surface of the recording material to which a toner image has been transferred by the transfer portion where a surface of the recording material in contact with the first rotary member is referred to as a front surface and a surface of the recording material in contact with the second rotary member is referred to as the back surface when the recording material is nipped and conveyed by the nip portion, and, a residual sheet detection unit configured to detect that the recording material remains in the nip portion between the nip portion and the transfer portion in the conveyance direction, the residual sheet detection unit including a second contact portion that is configured to come into contact with the back surface of the recording material to which the toner image has been transferred in the transfer portion. The first contact portion and the second contact portion are configured to rotate on the same rotation shaft. The second contact portion is configured to come into contact with the back surface of the recording material on a downstream of the first contact portion in the conveyance direction.

Further features of the present invention will become apparent from the following description of exemplary embodiments with reference to the attached drawings.

DESCRIPTION OF THE EMBODIMENTS

An embodiment will be described with reference to FIGS. 1 to 8. First, a schematic configuration of an image forming apparatus according to the present embodiment will be described with reference to FIG. 1.

Image Forming Apparatus

Figure 1:
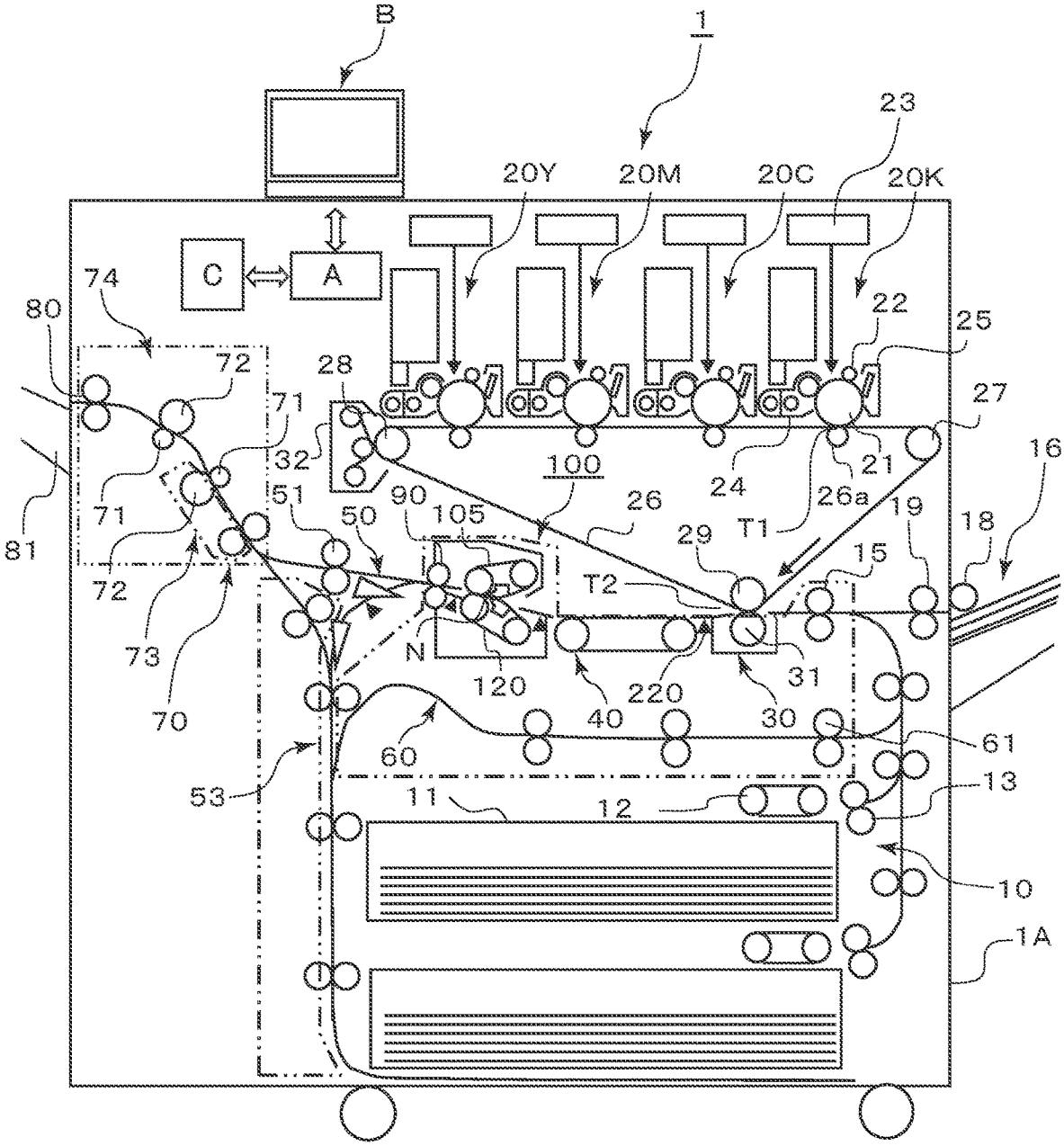
FIG. 1 is a schematic view of an image forming apparatus according to an embodiment.

FIG. 1 is a schematic configuration diagram of an image forming apparatus 1 to which the present embodiment is applied. The image forming apparatus 1 is a full-color laser beam printer using an electrophotographic system, and forms an image corresponding to electrical image information input from a host device C such as a personal computer or an image reader to a controller A (control unit 200) on a sheet (recording material) S and outputs the image. The controller A exchanges various types of electrical information with the host device C and an operation panel (operation unit) B, and integrally controls an image forming operation of the image forming apparatus according to a predetermined control program and a reference table.

As illustrated in FIG. 1, an apparatus body 1A of the image forming apparatus 1 is configured by arranging image forming units 20Y, 20M, 20C, and 20K corresponding to respective colors of yellow (Y), magenta (M), cyan (C), and black (K) in series serving as image forming units, for example. That is, the image forming apparatus employs a tandem system in which processes up to visualization are processed in parallel for each color. Each of the image forming units 20Y, 20M, 20C, and 20K has substantially the same configuration except that the color of the toner is different. Note that the arrangement order of the image forming units of the Y, M, C, and K colors is not limited to the illustrated example.

Each of the image forming units 20Y, 20M, 20C, and 20K includes the following process units. The image forming unit includes a photosensitive drum 21 serving as an image bearing member and a photosensitive member that bear an electrostatic latent image on the surface corresponding to each color of Y, M, C, and K, a charging roller 22 serving as a primary charging device, an exposing unit 23, a developing unit 24, and a cleaning device 25. The charging roller 22 uniformly charges the surface of the corresponding photosensitive drum 21 by applying a charging bias voltage having a set potential. The exposing unit 23 exposes the charged surface of the photosensitive drum 21 to form an electrostatic latent image on the surface of the photosensitive drum 21. The electrostatic latent image is toner-developed by the developing unit 24 and visualized as a toner image.

The toner image of each color formed and born on the surface of the photosensitive drum 21 of each of the image forming units 20Y, 20M, 20C, and 20K is sequentially superimposed and primarily transferred on an intermediate transfer belt 26 serving as an image bearing member at the primary transfer nip portion (primary transfer portion) T1 of a primary transfer device 26*a*. The transfer residual toner remaining on the photosensitive drum 21 after the primary transfer is removed by the cleaning device 25.

The intermediate transfer belt 26 is an endless belt, is supported across a driving roller 27, a tension roller 28, and an opposed roller 29, and is driven by the driving roller 27 to rotate in a clockwise direction indicated by an arrow. In a portion of the intermediate transfer belt 26 stretched around the opposed roller 29, a secondary transfer device 30 is disposed so as to face the opposed roller 29 via the intermediate transfer belt 26. A secondary transfer roller 31 serving as a transfer member provided in the secondary transfer device 30 is in pressure contact with the intermediate transfer belt 26 supported from the inside by the opposed roller 29 to form a secondary transfer portion (secondary transfer nip portion) T2 between the secondary transfer roller 31 and the intermediate transfer belt 26.

As described above, the toner images on the intermediate transfer belt 26 to which all the Y, M, C, and K colors have been primarily transferred are collectively secondarily transferred onto a sheet S at the secondary transfer portion T2. Examples of the recording material include sheet materials such as paper, a plastic film, and cloth.

A belt cleaning device 32 slides the cleaning web on the intermediate transfer belt 26 to remove transfer residual toner, paper dust, and the like remaining on the surface of the intermediate transfer belt 26 through the secondary transfer portion T2.

On the other hand, a sheet feeding device 10 separates the sheet S drawn out from a sheet storage cassette 11 by a pickup roller 12 one by one by a separation device 13 and feeds the sheet S to a registration roller 15. The registration roller 15 receives the sheet S in a stopped state, causes the sheet S to stand by, and feeds the sheet S to the secondary transfer portion T2 in synchronization with the toner image on the intermediate transfer belt 26 (on the image bearing member).

Further, a sheet having a large length in the conveyance direction, such as a long sheet, is fed from a long sheet feeding device 16 provided on the right side surface of the image forming apparatus 1. That is, in the long sheet feeding device 16, the sheet S drawn out from a manual feed tray 17 by a pickup roller 18 is separated one by one by a separation device 19 and fed to the registration roller 15.

The sheet S bearing the toner image transferred by the secondary transfer portion T2 is conveyed to the fixing device 100 by a belt conveyance device (pre-fixing conveyance unit) 40. The belt conveyance device 40 serving as a conveyance unit is, for example, a conveyor belt that adsorbs and conveys the sheet S, and is disposed between the secondary transfer portion T2 and the fixing device 100. The belt conveyance device 40 is disposed to feed the sheet S discharged from the secondary transfer portion T2 to the fixing device 100 while assisting the conveying posture of the sheet S. In the present embodiment, the belt conveyance device 40 is formed of a belt stretched between rollers, but may have a configuration of only a guide member that guides the sheet S. The sheet S having passed through the secondary transfer portion T2 is delivered to the belt conveyance device 40, and is conveyed to the fixing device 100 by the belt conveyance device 40. The belt conveyance device 40 may be omitted, and the sheet S that has passed through the secondary transfer portion T2 may be directly conveyed to the fixing device 100.

In the fixing device 100, the sheet S is nipped by a fixing nip portion N formed by a fixing belt 105 (first rotary member) and a pressure belt 120 (second rotary member) serving as a pair of rotary members, and the toner image is fixed to the sheet S by applying heat and pressure to the unfixed toner image on the sheet.

The sheet S fed from the fixing device 100 after completion of the fixing processing is conveyed toward a discharge path 50, a double-sided conveyance path 60, or the like by a conveyance roller pair 90. In the case of the single-sided printing mode, the sheet S on which the toner image is fixed proceeds to the discharge path 50, passes through a decurling device 70 by a discharge roller 51, is discharged from a discharge port 80 onto a sheet discharge tray 81, and is stacked.

The decurling device 70 serving as a decurling unit is configured by a pair of rollers of a metal roller 71 and a sponge roller 72 in which a material such as urethane rubber is wound around the outside of a metal shaft. When the sheet S passes, the sponge roller 72 enters the metal roller 71 by a pressurizing mechanism (not illustrated). Accordingly, a decurl nip portion is formed, and the sheet is caused to pass through the decurl nip portion to correct curl of the sheet. In order to correct curl in the upward and downward directions of the sheet S discharged from the image forming apparatus 1, a lower decurling portion 73 and an upper decurling portion 74 are provided.

In the case of the double-sided printing mode, the sheet S on which the toner image is fixed one side proceeds to a reverse path 53, is switched back, is fed to the double-sided conveyance path 60, and waits at a re-feeding roller 61. Thereafter, the sheet S is fed to the secondary transfer portion T2 by the registration roller 15, the toner image is also secondarily transferred to the back surface of the sheet, and the unfixed toner image is fixed by the fixing device 100.

As described above, the image forming apparatus 1 executes a series of image forming processes such as charging, exposure, development, transfer, and fixing, and forms and discharges a color toner image on the sheet S. In the case of the monochrome image forming apparatus, only a black (K) photosensitive drum is present, and the toner image formed on the photosensitive drum is transferred to the sheet S by a transfer device.

In addition, the image forming apparatus 1 is provided with an operation panel B serving as an operation unit, and the operation panel B includes various buttons and operation switches operated by a user, and a display unit that displays a message to the user, an error such as occurrence of a jam, and the like.

Fixing Device

Figure 2:
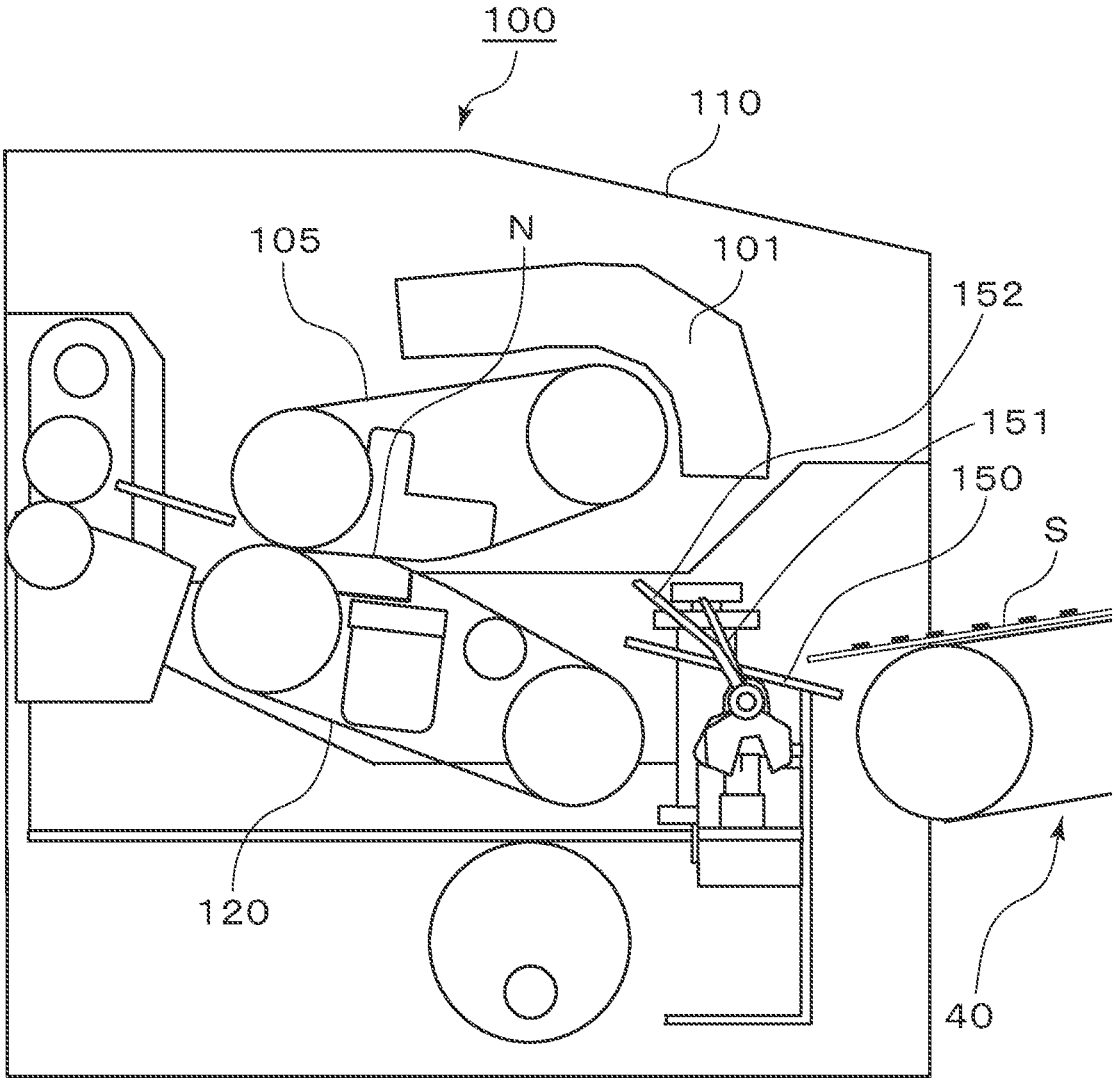
FIG. 2 is a schematic configuration cross-sectional view of a fixing device according to the embodiment.

Next, a fixing device 100 which is an image heating device of the present embodiment will be described with reference to FIG. 2. The fixing device 100 includes the fixing belt 105 and the pressure belt 120 serving as a pair of rotary members. The pressure belt 120 serving as a pressure rotary member is brought into contact with the outer peripheral surface of the fixing belt 105 serving as a heating rotary member to form the fixing nip portion N that heats the toner image on the sheet. Such a fixing device 100 is an image heating device of a belt nip type, an electromagnetic induction heating type, or an oilless fixing type. Specifically, the fixing belt 105 includes the electromagnetic induction heating unit 101 and generates heat by electromagnetic induction.

Note that the configuration of the pair of rotary members is not limited thereto. For example, both of the pair of rotary members may be rollers, or a belt on the heating side may be a film. Furthermore, one may be an endless belt, and the other may be a roller. The heating method is not limited to the IH type, and a halogen heater may be disposed in a roller that stretches the belt. When a film is used as the heating rotary member, the film may be heated by a ceramic heater or the like. When a roller is used as the heating rotary member, a halogen heater may be disposed in the roller.

The fixing belt 105 and the pressure belt 120 are disposed inside a casing 110. That is, the fixing device 100 includes the casing 110, a fixing belt 105 and the pressure belt 120 serving as a pair of rotary members disposed inside the casing 110, a fixing inlet guide 150, a loop detection unit 151, and a residual sheet detection unit 152. In the casing 110, an inlet and an outlet of the sheet S are open.

The fixing inlet guide 150 is provided upstream in the conveyance direction of the sheet S in the fixing nip portion N formed by pressing the pressure belt 120 against the fixing belt 105. The fixing inlet guide 150 guides the sheet S bearing the unfixed toner image in the secondary transfer portion T2 from the belt conveyance device 40 to the inlet of the fixing nip portion N. That is, the fixing inlet guide 150 is disposed between the inlet of the casing 110 and the fixing nip portion N, and guides the sheet S entering from the inlet of the casing 110 and bearing the unfixed toner image to the fixing nip portion N. The sheet S guided along the fixing inlet guide 150 is heated and pressurized while being nipped and conveyed by the fixing belt 105 and the pressure belt 120 at the fixing nip portion N. As a result, the toner image is fixed to the sheet S. The loop detection unit 151 detects that a loop is formed on the sheet S. The residual sheet detection unit 152 detects that a sheet remains in the fixing device 100. The loop detection unit 151 and the residual sheet detection unit 152 are provided in the fixing inlet guide 150.

Loop Detection and Residual Sheet Detection Mechanism

Figure 3A:
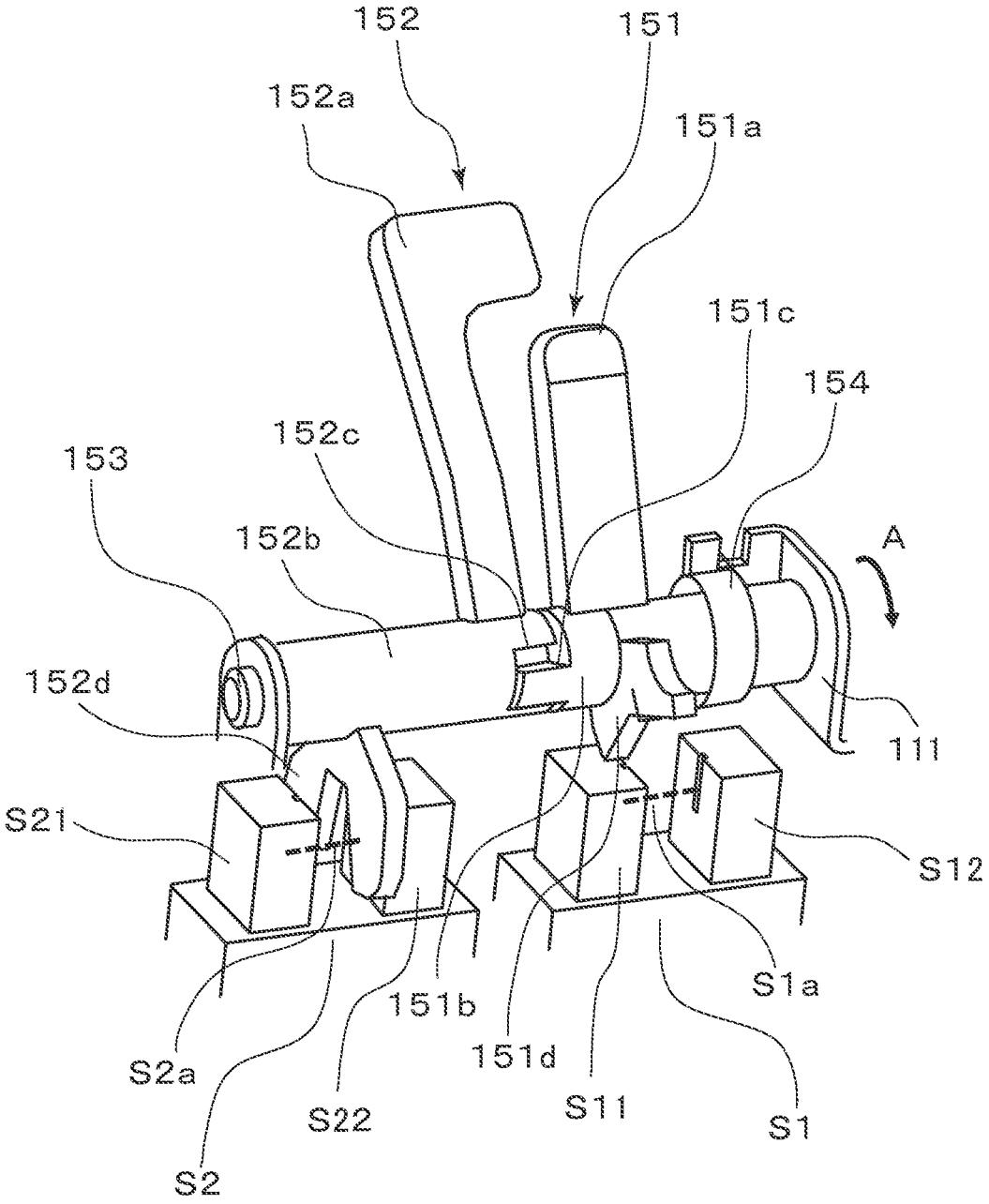
FIG. 3A is a perspective view of a loop detection unit and a residual sheet detection unit according to the embodiment.
Figure 3B:
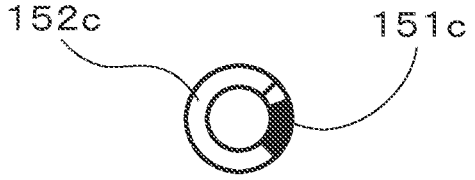
FIG. 3B is a cross-sectional view of an engagement portion between a loop detection flag and a residual sheet detection flag.

Next, the loop detection and residual sheet detection mechanism will be described with reference to FIGS. 3A and 3B. As illustrated in FIG. 3A, the loop detection unit 151 and the residual sheet detection unit 152 are provided such that a loop detection flag 151*a* and a residual sheet detection flag 152*a* rotate about the same rotation shaft 153. The rotation shaft 153 is disposed upstream of the fixing nip portion N in the casing 110 in the sheet conveyance direction. The loop detection unit 151 and the residual sheet detection unit 152 are provided in the fixing inlet guide 150. The residual sheet detection unit 152 includes a residual sheet detection sensor S2 serving as a first sensor, and the loop detection unit 151 includes a loop detection sensor S1 serving as a second sensor. Hereinafter, each configuration will be specifically described.

Loop Detection Unit

The loop detection unit 151 includes the loop detection flag 151*a* serving as a first contact portion, a cylindrical portion 151*b*, an engagement protrusion portion 151*c* serving as a first engagement portion, a light shielding portion 151*d*, and the loop detection sensor S1. The loop detection flag 151*a* is a plate-shaped or bar-shaped member having a base end portion fixed to the cylindrical portion 151*b* and extending in the radial direction of the cylindrical portion 151*b*. The cylindrical portion 151*b* is directly fixed to the frame 111 of the fixing device 100 directly, or externally fitted to the rotation shaft 153 supported by the fixing inlet guide 150 provided in the frame 111 so as to be relatively rotatable. The frame 111 also supports rollers that stretch the fixing belt 105 and the pressure belt 120.

The engagement protrusion portion 151*c* is formed so as to protrude in the rotation axis direction from a part of the cylindrical portion 151*b* in the circumferential direction. The light shielding portion 151*d* is fixed to the cylindrical portion 151*b* at a position different from the loop detection flag 151*a* in the circumferential direction, and extends in the radial direction of the cylindrical portion 151*b*. The loop detection flag 151*a*, the cylindrical portion 151*b*, the engagement protrusion portion 151*c*, and the light shielding portion 151*d* are integrally formed of, for example, resin. The loop detection flag 151*a* is rotatably supported with respect to the rotation shaft 153 via the cylindrical portion 151*b*, and the engagement protrusion portion 151*c* and the light shielding portion 151*d* rotate (swing) about the rotation shaft 153 together with the loop detection flag 151*a*.

The loop detection sensor S1 is a sensor capable of detecting the rotation position of the loop detection flag 151*a*, and is a photo-interrupter in the present embodiment. That is, the loop detection sensor S1 includes a light emitting unit S11 and a light receiving unit S12 capable of receiving light S1*a* emitted from the light emitting unit S11. The light shielding portion 151*d* can pass between the light emitting unit S11 and the light receiving unit S12. The light S1*a* emitted from the light emitting unit S11 is shielded by the light shielding portion 151*d*, so that the loop detection sensor S1 can detect the rotation position of the loop detection flag 151*a*.

Residual Sheet Detection Unit

The residual sheet detection unit 152 includes the residual sheet detection flag 152*a* serving as a second contact portion, a cylindrical portion 152*b*, an engagement recess portion 152*c* serving as a second engagement portion, a light shielding portion 152*d*, and the residual sheet detection sensor S2. The residual sheet detection flag 152*a* is a plate-shaped or bar-shaped member having a base end portion fixed to the cylindrical portion 152*b* and extending in the radial direction of the cylindrical portion 152*b*. The residual sheet detection flag 152*a* is longer than the loop detection flag 151*a* and is arranged at a position adjacent to the loop detection flag 151*a*. Therefore, a distal end portion of the residual sheet detection flag 152*a* is located at a position farther from the rotation center than a distal end portion of the loop detection flag 151*a*. That is, the distal end portion of the residual sheet detection flag 152*a* can be disposed closer to the inlet of the fixing nip portion N than the distal end portion of the loop detection flag 151*a*.

Further, the distal end portion of the residual sheet detection flag 152*a* is formed so as to protrude toward the loop detection flag 151*a* than the intermediate portion, and can come into contact with the sheet with an area larger than the distal end portion of the loop detection flag 151*a*. The residual sheet detection flag 152*a* and the loop detection flag 151*a* are arranged so as not to interfere with each other even if each of the residual sheet detection flag 152*a* and the loop detection flag 151*a* rotates about the rotation shaft 153. The cylindrical portion 152*b* is externally fitted so as to be relatively rotatable with respect to the rotation shaft 153 so as to be adjacent to the cylindrical portion 151*b*.

The engagement recess portion 152*c* is formed so as to be recessed in the rotation axis direction in a part of the circumferential direction of the cylindrical portion 152*b*. The engagement protrusion portion 151*c* can enter the engagement recess portion 152*c*, and the engagement protrusion portion 151*c* and the engagement recess portion 152*c* are engaged with each other, so that the loop detection flag 151*a* and the residual sheet detection flag 152*a* can be integrally rotated. As shown in FIG. 3B, since the circumferential width of the engagement recess portion 152*c* is wider than the circumferential width of the engagement protrusion portion 151*c*, the loop detection flag 151*a* and the residual sheet detection flag 152*a* can rotate independently of each other in a predetermined rotation range (difference in circumferential width between the engagement protrusion portion 151*c* and the engagement recess portion 152*c*). The relationship between the engagement protrusion portion and the engagement recess portion may be reversed. That is, the loop detection unit 151 side may be used as the engagement recess portion, and the residual sheet detection unit 152 side may be used as the engagement protrusion portion.

The light shielding portion 152*d* is fixed to the cylindrical portion 152*b* at a position different from the position of the residual sheet detection flag 152*a* in the circumferential direction, and extends in the radial direction of the cylindrical portion 152*b*. In the case of the present embodiment, the light shielding portion 152*d* is formed so as to be bifurcated, and light S2*a* to be described below can be shielded at two places in the circumferential direction. The residual sheet detection flag 152*a*, the cylindrical portion 152*b*, the engagement recess portion 152*c*, and the light shielding portion 152*d* described above are integrally formed of, for example, resin. The residual sheet detection flag 152*a* is rotatably supported with respect to the rotation shaft 153 via the cylindrical portion 152*b*, and the engagement recess portion 152*c* and the light shielding portion 152*d* rotate (swing) about the rotation shaft 153 together with the residual sheet detection flag 152*a*.

The residual sheet detection sensor S2 is a sensor capable of detecting the rotation position of the residual sheet detection flag 152*a*, and is a photo-interrupter in the present embodiment. That is, the residual sheet detection sensor S2 includes a light emitting unit S21 and a light receiving unit S22 capable of receiving light S2*a* emitted from the light emitting unit S21. The light shielding portion 152*d* can pass between the light emitting unit S21 and the light receiving unit S22. The light S2*a* emitted from the light emitting unit S21 is shielded by the light shielding portion 152*d*, so that the residual sheet detection sensor S2 can detect the rotation position of the residual sheet detection flag 152*a*.

The rotation shaft 153 is disposed below the fixing inlet guide 150, and the loop detection flag 151*a* and the residual sheet detection flag 152*a* can protrude above the fixing inlet guide 150 through an opening portion or a notch formed in the fixing inlet guide 150. As a result, the loop detection flag 151*a* and the residual sheet detection flag 152*a* can come into contact with the sheet S conveyed from the secondary transfer portion T2 to the fixing inlet guide 150 via the belt conveyance device 40. That is, when the sheet S is nipped and conveyed by the fixing nip portion N, in a case where a surface of the sheet S in contact with the fixing belt 105 is a front surface and a surface of the sheet S in contact with the pressure belt 120 is a back surface, the loop detection flag 151*a* comes into contact with the back surface of the sheet S, so that the loop detection unit 151 detects that the sheet S is looped between the fixing nip portion N and the secondary transfer portion T2 in the conveyance direction of the sheet S. When the residual sheet detection flag 152*a* comes into contact with the back surface of the sheet S, the residual sheet detection unit 152 detects that the sheet remains in the fixing nip portion N between the fixing nip portion N and the secondary transfer portion T2 in the conveyance direction of the sheet S.

In the case of the present embodiment, a rotational spring 154 serving as a common biasing unit that applies a biasing force to the loop detection flag 151*a* and the residual sheet detection flag 152*a* is provided. The rotational spring 154 biases the loop detection flag 151*a* and the residual sheet detection flag 152*a* toward the sheet conveyance path between the secondary transfer portion T2 and the fixing nip portion N. Specifically, the rotational spring 154 is provided to bias the loop detection flag 151*a* in the direction of the arrow A in FIG. 3A.

The biasing direction of the rotational spring 154 is opposite to a direction in which the loop detection flag 151*a* is pressed against the sheet S conveyed from the secondary transfer portion T2 via the belt conveyance device 40. When the loop detection flag 151*a* is biased in the direction of arrow Aby the rotational spring 154 and the engagement protrusion portion 151*c* and the engagement recess portion 152*c* are engaged with each other, the biasing force is also transmitted to the residual sheet detection flag 152*a*. Accordingly, the loop detection flag 151*a* and the residual sheet detection flag 152*a* can be biased toward the sheet conveyance path by the rotational spring 154 which is a common biasing unit.

Loop Detection Operation and Residual Sheet Detection Operation

Next, a loop detection operation and a residual sheet detection operation performed using the loop detection unit 151 and the residual sheet detection unit 152 described above will be described with reference to FIGS. 4A to 5B. Note that FIGS. 4A to 5B also illustrate cross-sectional views of engagement portions of the engagement protrusion portion 151*c* and the engagement recess portion 152*c* in addition to the schematic views of the belt conveyance device 40 to the fixing nip portion N as viewed from the side. The engagement portion cross-sectional view is a cross-sectional view of the belt conveyance device 40 to the fixing nip portion N viewed from the same direction as the schematic view viewed from the side, and the positional relationship between the engagement protrusion portion 151*c* and the engagement recess portion 152*c* coincides with the schematic view.

When the sheet S passes on the fixing inlet guide 150, the loop detection flag 151*a* and the residual sheet detection flag 152*a* are pressed by the sheet S and rotate about the rotation shaft 153. As described above, the rotational spring 154 applies rotating power to the loop detection flag 151*a* in a direction opposite to the pressing by the sheet S (arrow A direction in FIG. 3A and clockwise direction in FIGS. 4A to 4C and FIGS. 5A and 5B).

The distal end portion of the loop detection flag 151*a* pressed by the sheet S is disposed so as to be rotatable between a state L1 (see FIG. 4A) in which a loop is generated due to a difference between a conveyance speed of the sheet S conveyed by the intermediate transfer belt 26 and the belt conveyance device 40 and a conveyance speed of the sheet S conveyed by the fixing device 100 and a state L2 (see FIG. 4C) in which the loop is eliminated. The belt conveyance device 40 is designed to convey a sheet at substantially the same speed as a sheet conveyance speed in the secondary transfer portion T2. Similarly, a sheet conveyance speed in the fixing device 100 is designed to convey the sheet at substantially the same speed. However, in the fixing device 100, the drive roller among the rollers that stretch the fixing belt 105 and the pressure belt 120 rotates to rotate each belt. Since the fixing belt 105 and the pressure belt 120 rotate following the rotational drive of the drive roller, slight slip occurs between the drive roller and the belt. As a result, an error occurs in the rotational speed of the belt. The same applies to the belt conveyance device 40. Therefore, there is a possibility that the sheet conveyance speed in the fixing device 100 and the sheet conveyance speed in the secondary transfer portion T2 are different.

On the other hand, in recent years, the demand for printing on a long sheet has increased. In the conveyance direction of the recording material, there are more cases of printing a long sheet which is a recording material longer than the distance between the secondary transfer portion T2 and the fixing nip portion N. In a case where the secondary transfer portion T2 and the fixing nip portion N nip and convey the sheet at the same time and the sheet conveyance speed in the fixing device 100 becomes faster than the sheet conveyance speed in the secondary transfer portion T2, there is a possibility that the fixing device 100 pulls the sheet and the image is not transferred to a desired region on the sheet (transfer deviation). In order to suppress the transfer deviation, the loop detection sensor detects the loop amount of the sheet and controls the sheet conveyance speed in the fixing device. Details thereof will be described below.

In the loop detection sensor S1, when the light shielding portion 151*d* shields the light S1*a* of the loop detection sensor S1, the loop detection sensor S1 is turned on, and when the light S1*a* of the loop detection sensor S1 is transmitted, the loop detection sensor S1 is turned off. Therefore, as illustrated in FIG. 4A, the position of the light shielding portion 151*d* with respect to the distal end portion of the loop detection flag 151*a* is defined such that the light shielding portion 151*d* turns on the loop detection sensor S1 when the distal end portion of the loop detection flag 151*a* reaches the position of the state L1 where the loop has occurred.

Figure 4A:
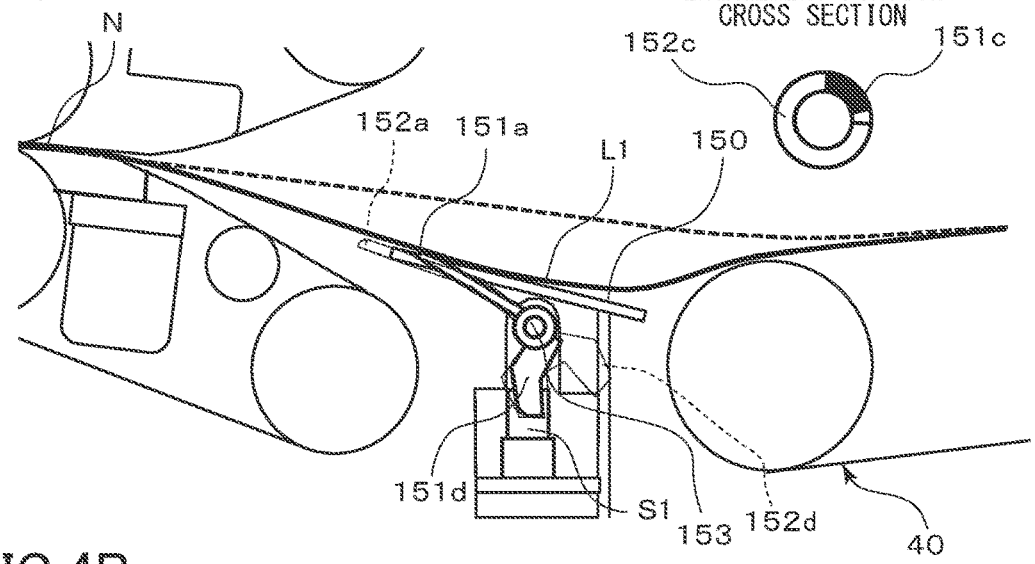
FIG. 4A is a diagram for explaining a state in which a sheet is looped.

In the state of FIG. 4A, the residual sheet detection flag 152*a* rotates counterclockwise together with the loop detection flag 151*a* due to the engagement of the engagement protrusion portion 151*c* and the engagement recess portion 152*c*. Therefore, the light shielding portion 152*d* of the residual sheet detection unit 152 also shields the light S2*a* of the residual sheet detection sensor S2, and the residual sheet detection sensor S2 is also turned on. At this time, the engagement positions of the engagement protrusion portion 151*c* and the engagement recess portion 152*c* may be set so that the distal end portion of the residual sheet detection flag 152*a* does not come into contact with the sheet S in the state L1.

Figure 4B:
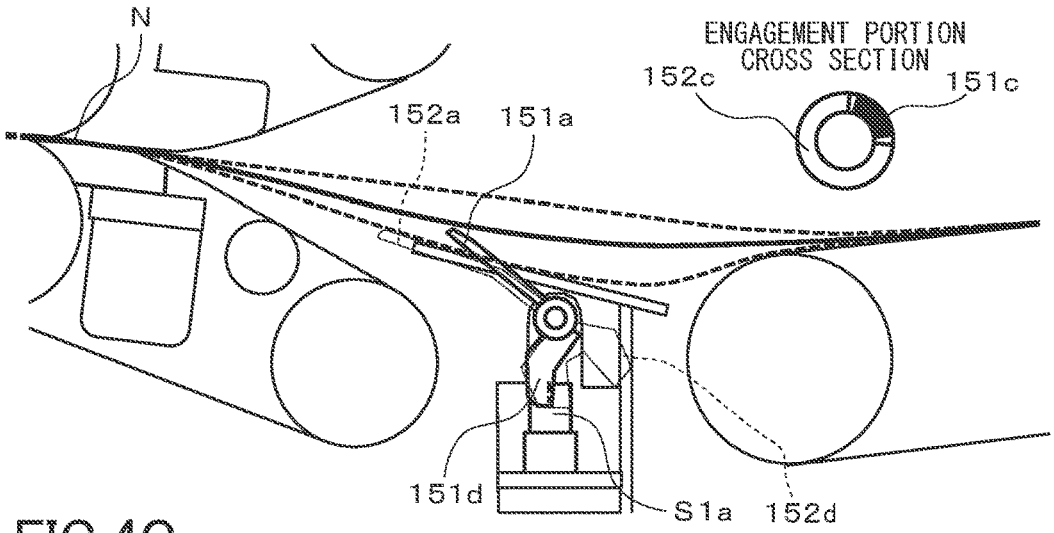
FIG. 4B is a diagram for explaining a state in which the loop of the sheet starts to be eliminated.

As described below, when the loop detection unit 151 detects a loop of the sheet, the sheet conveyance speed by the fixing device 100 is increased to eliminate the loop of the sheet. At this time, as shown in FIG. 4B, when the loop of the sheet starts to be eliminated, the loop detection flag 151*a* starts to rotate clockwise in the drawing following the sheet by the rotational spring 154. Then, as illustrated in the engagement portion cross section of FIG. 4B, the engagement of the engagement protrusion portion 151*c* and the engagement recess portion 152*c* is released. At this time, the residual sheet detection flag 152*a* remains at the position illustrated in FIG. 4A due to its own weight, and does not come into contact with the sheet.

That is, the engagement protrusion portion 151*c* of the loop detection flag 151*a* and the engagement recess portion 152*c* of the residual sheet detection flag 152*a* are engaged so as to be independently rotatable within a predetermined rotation range. Therefore, as illustrated in FIG. 4B, while the light shielding portion 151*d* of the loop detection unit 151 shields the light S1*a* of the loop detection sensor S1, the distal end portion of the residual sheet detection flag 152*a* is located below (dotted line position) the distal end portion of the loop detection flag 151*a* by its own weight.

Figure 4C:
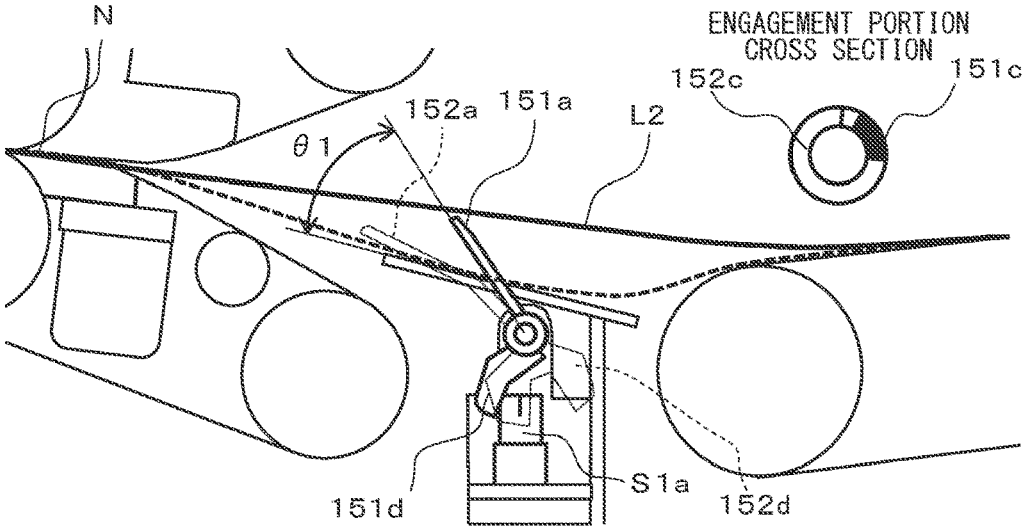
FIG. 4C is a diagram for explaining a state in which the loop of the sheet is eliminated.

Next, as illustrated in a state L2 of FIG. 4C, when the loop of the sheet is eliminated, the light shielding portion 151*d* of the loop detection unit 151 transmits the light S1*a* of the loop detection sensor S1, and the loop detection sensor S1 is turned off. Then, as described below, the sheet conveyance speed of the fixing device 100 is reduced, and a loop is formed again. At this time, as illustrated in the engagement portion cross section of FIG. 4C, the engagement protrusion portion 151*c* and the engagement recess portion 152*c* are engaged, and the residual sheet detection flag 152*a* rotates clockwise and protrudes upward from the fixing inlet guide 150. However, even in this state, the distal end portion of the residual sheet detection flag 152*a* is positioned below the distal end portion of the loop detection flag 151*a*.

Figure 5A:
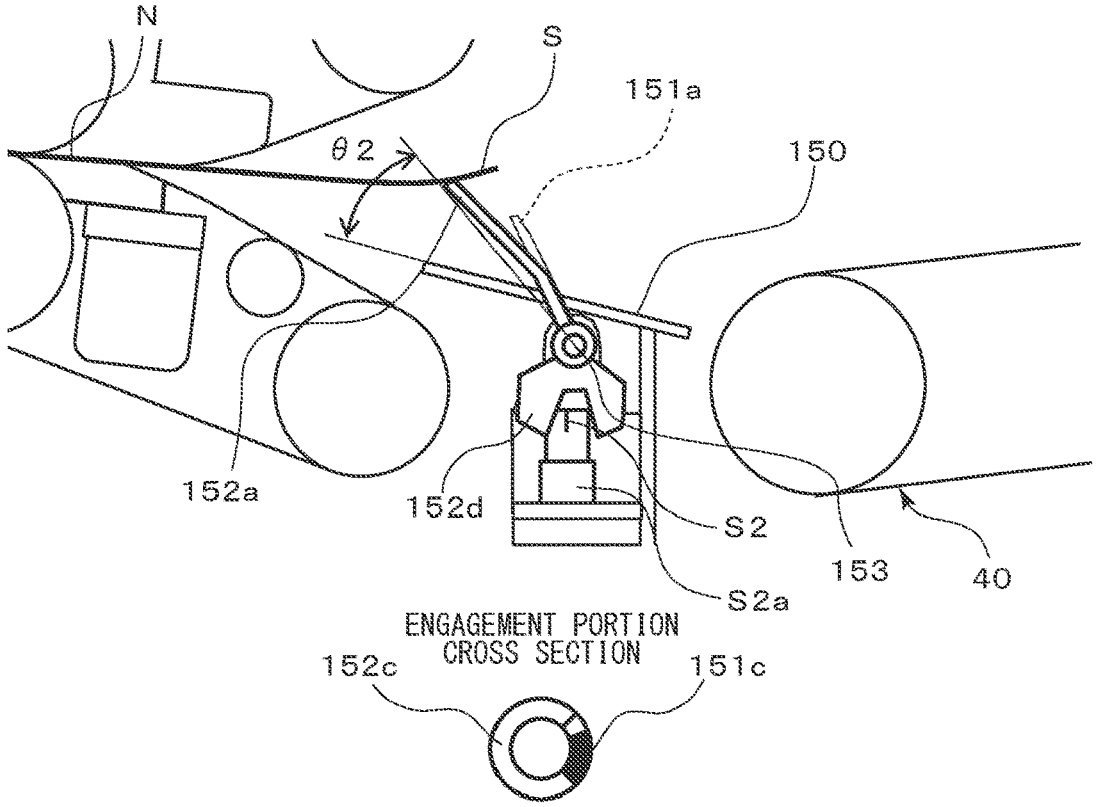
FIG. 5A is a diagram for explaining a state in which a residual sheet detection flag is in contact with a trailing edge of a residual sheet.
Figure 5B:
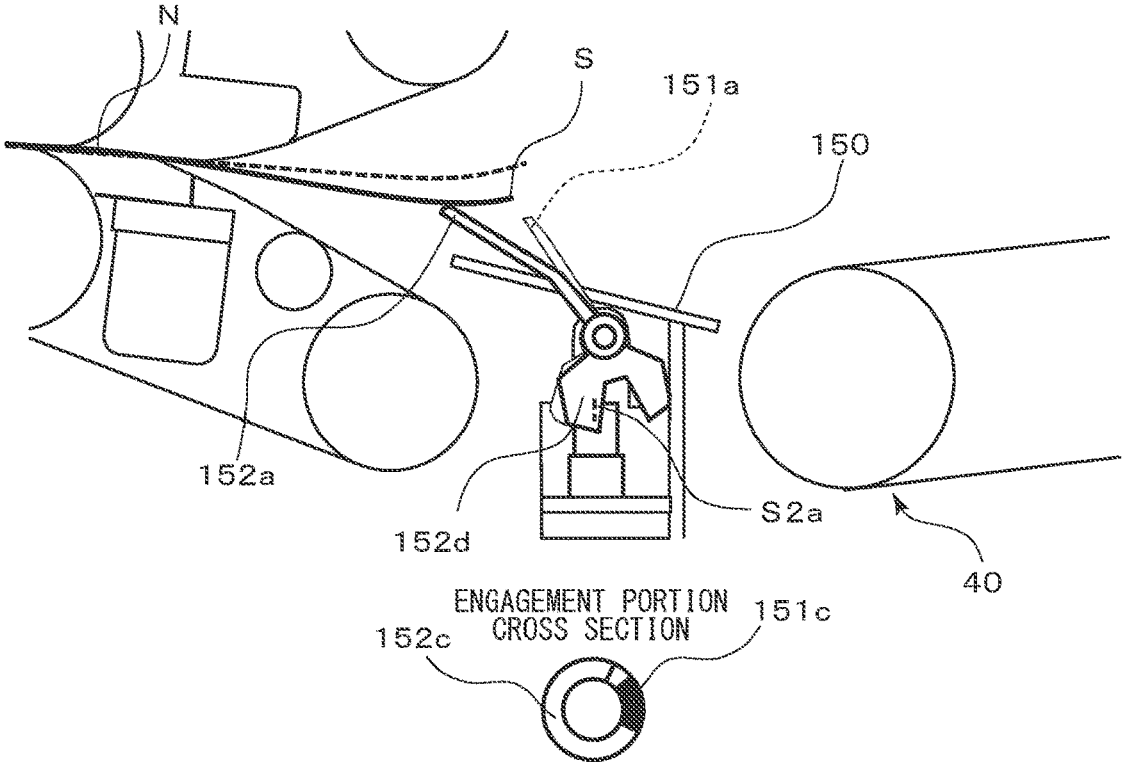
FIG. 5B is a diagram for explaining a state in which a residual sheet is detected by a residual sheet detection unit.

Next, as illustrated in FIG. 5B, when the sheet S remains in the fixing nip portion N at the time of a jam or the like, the trailing edge of the sheet S is detected by the residual sheet detection flag 152*a* of the residual sheet detection unit 152. In the present embodiment, even when a small-sized sheet having a length of about 150 mm in the sheet conveyance direction such as a postcard or an envelope remains in the fixing nip portion N, the distal end of the residual sheet detection flag 152*a* is extended to the vicinity of the inlet of the fixing nip portion N so that the residual sheet can be detected. Therefore, the distal end portion of the residual sheet detection flag 152*a* rotates at a position closer to the fixing nip portion N than the distal end portion of the loop detection flag 151*a*.

As illustrated in FIG. 5A, in a state where the distal end portion of the loop detection flag 151*a* is not in contact with the sheet, the biasing force of the rotational spring 154 is transmitted to the residual sheet detection flag 152*a* via the engagement portion between the engagement protrusion portion 151*c* and the engagement recess portion 152*c*. Then, the residual sheet detection flag 152*a* rotates clockwise until the distal end portion comes into contact with the sheet S. FIG. 5A illustrates a state in which the residual sheet detection flag 152*a* is in contact with the trailing edge of the sheet S conveyed by the fixing nip portion N, but the light shielding portion 152*d* of the residual sheet detection unit 152 does not shield the light S2*a* of the residual sheet detection sensor S2. In addition, the light shielding portion 151*d* of the loop detection unit 151 is also in a state of not shielding the light S1*a* of the loop detection sensor S1.

Next, as illustrated in FIG. 5B, when the sheet S remains in the fixing nip portion N due to occurrence of a jam or the like, the sheet S follows the direction of the nip surface of the fixing nip portion N, so that the trailing edge of the sheet S is lowered from the broken line position to the solid line position. Then, the residual sheet detection flag 152*a* in contact with the trailing edge of the sheet S rotates counterclockwise, and the light shielding portion 152*d* of the residual sheet detection flag 152*a* shields the light S2*a* of the residual sheet detection sensor S2. Even in this state, the light shielding portion 151*d* of the loop detection unit 151 does not shield the light S1*a* of the loop detection sensor S1. Since the light shielding portion 152*d* shields the light S2*a* of the residual sheet detection sensor S2, the residual sheet detection sensor S2 is turned on, and it is detected that the sheet S remains in the fixing nip portion N.

As described above, in the present embodiment, as illustrated in FIGS. 5A and 5B, the engagement protrusion portion 151*c* of the loop detection unit 151 and the engagement recess portion 152*c* of the residual sheet detection unit 152 are engaged until the light shielding portion 152*d* shields the light S2*a* of the residual sheet detection sensor S2. Therefore, the residual sheet detection flag 152*a* rotates in the clockwise direction together with the loop detection flag 151*a* by the rotational spring 154 only during this period.

In the present embodiment, the rotation angle θ1 of the loop detection flag 151*a* is set to 50 degrees, and the rotation angle θ2 of the residual sheet detection flag 152*a* is set to 30 degrees. Then, a region (predetermined angular range) θ2−θ1=20 deg in which the engagement protrusion portion 151*c* of the loop detection unit 151 and the engagement recess portion 152*c* of the residual sheet detection unit 152 are not engaged is provided. In this manner, by setting the rotation angle of the residual sheet detection flag 152*a* to be larger than the rotation angle of the loop detection flag 151*a* by 20 degrees, the loop detection flag 151*a* can be independently rotated by the rotation angle of 20 degrees.

The loop detection flag 151*a* and the residual sheet detection flag 152*a* are provided in the fixing inlet guide 150 and are biased toward the sheet conveyance path. As a result, the loop detection flag 151*a* and the residual sheet detection flag 152*a* come into contact with the sheet surface (back surface) that comes into contact with the pressure belt 120. By providing the loop detection flag 151*a* and the residual sheet detection flag 152*a* so as to come into contact with the back surface, it is possible to suppress the loop detection flag 151*a* and the residual sheet detection flag 152*a* from coming into contact with the unfixed toner.

Control Unit

Figure 6:
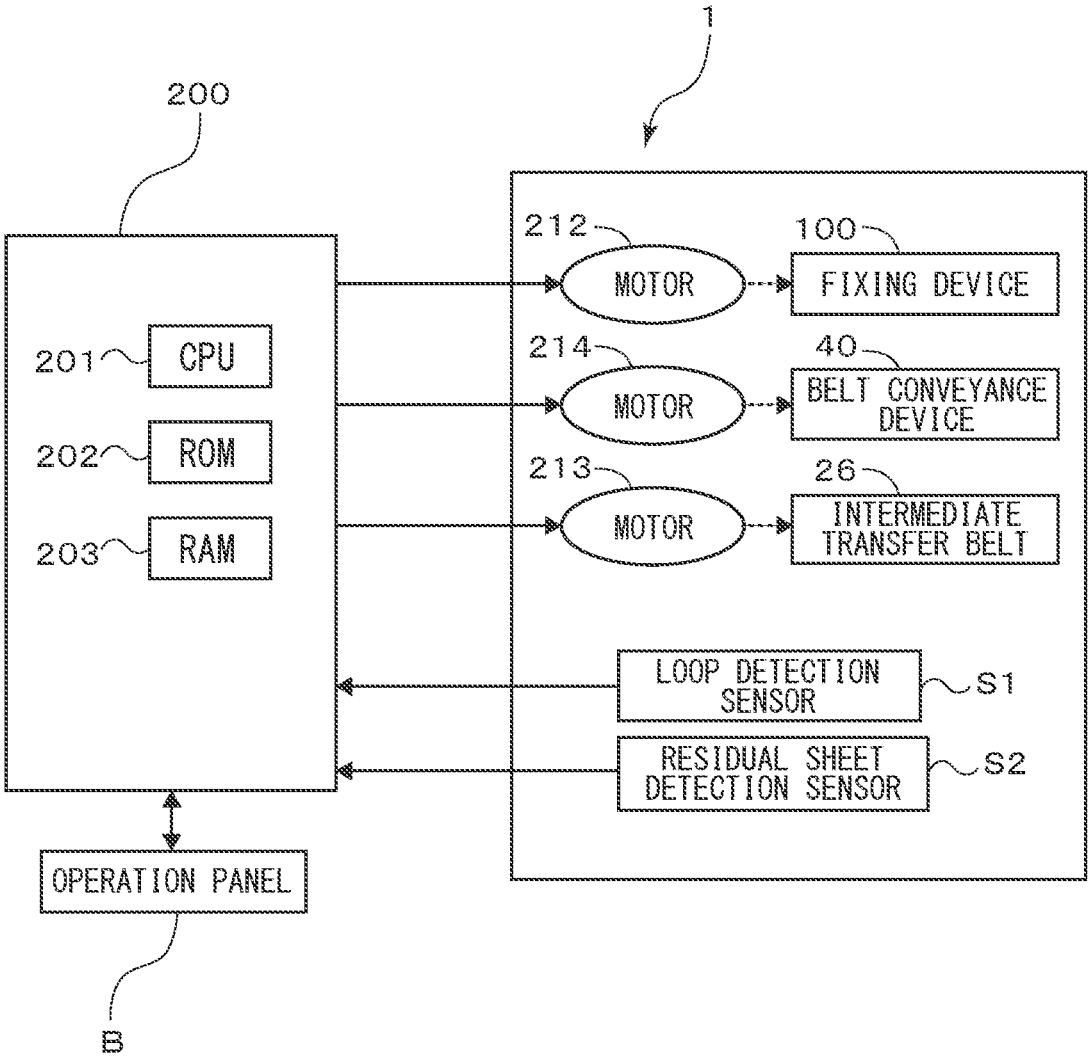
FIG. 6 is a control block diagram of the image forming apparatus according to the embodiment.

A configuration of a control unit that performs fixing speed control of the image forming apparatus according to the present embodiment will be described with reference to a block diagram of FIG. 6. The control unit 200 includes a CPU 201, a ROM 202, and a RAM 203, and controls the entire operation of the image forming apparatus 1. The CPU 201 controls the operation of the entire image forming apparatus according to a control program stored in the ROM 202. The ROM 202 stores programs executed by the CPU 201, various default values, and data. The RAM 203 provides a work area for temporarily storing various data at the time of control processing by the CPU 201, and also stores various flags, data, and the like referred to by the program.

The image forming apparatus 1 includes the image forming units 20Y to 20K, the intermediate transfer belt 26, the sheet feeding device 10, and the like illustrated in FIG. 1, and executes a function of transferring an image corresponding to the input image information to the sheet S to form an unfixed toner image under the control of the control unit 200. The motor 212 rotationally drives the roller of the fixing device 100 according to an instruction from the control unit 200. Specifically, the motor 212 drives the drive roller among the rollers stretching the fixing belt 105 and the drive roller among the rollers stretching the pressure belt 120 to convey the sheet nipped by the fixing nip portion N. In addition, the motor 213 rotationally drives the intermediate transfer belt 26 of the image forming unit according to an instruction from the control unit 200. In addition, the motor 214 rotationally drives the belt conveyance device 40 of the image forming unit according to an instruction of the control unit 200. In addition to these, the image forming apparatus 1 includes a rotation drive mechanism that rotationally drives the image forming units 20Y to 20K, the sheet feeding device 10, the rollers of the decurling device 70, and the like illustrated in FIG. 1, but these are omitted here.

The operation panel B includes various buttons and operation switches operated by the user, and a display unit that displays messages to the user, an error such as occurrence of a jam, and the like. In the above description, one loop detection sensor S1 and one residual sheet detection sensor S2 are provided, but the number of sensors to be arranged may be increased in order to improve the position detection accuracy of the flag.

Loop Control

Here, the loop control of detecting the loop state of the sheet using the above-described loop detection unit 151 and controlling the sheet conveyance speed of the fixing device 100 will be described. When the loop detection sensor S1 does not detect a loop of the sheet during conveyance of the sheet, the control unit 200 sets the conveyance speed of the sheet by the fixing belt 105 and the pressure belt 120 to a first speed. On the other hand, when the loop detection sensor S1 detects the loop of the sheet, the control unit 200 sets the sheet conveyance speed by the fixing belt 105 and the pressure belt 120 to a second speed higher than the first speed.

That is, in a state where the sheet is not looped, the control unit 200 slows the rotational speed of the motor 212 that drives the fixing device 100 to lower the speed at which the sheet is conveyed by the fixing belt 105 and the pressure belt 120 than the speed at which the sheet is conveyed by the secondary transfer portion T2 and the belt conveyance device 40. As a result, a loop is formed on the sheet conveyed by the belt conveyance device 40 and the fixing nip portion N. On the other hand, in a state where the sheet is looped, the control unit 200 increases the rotational speed of the motor 212, so that the speed at which the sheet is conveyed by the fixing belt 105 and the pressure belt 120 is faster than the speed at which the sheet is conveyed by the secondary transfer portion T2 and the belt conveyance device 40. As a result, the conveyance speed of the sheet is secured without making the loop of the sheet too large.

Figure 7:
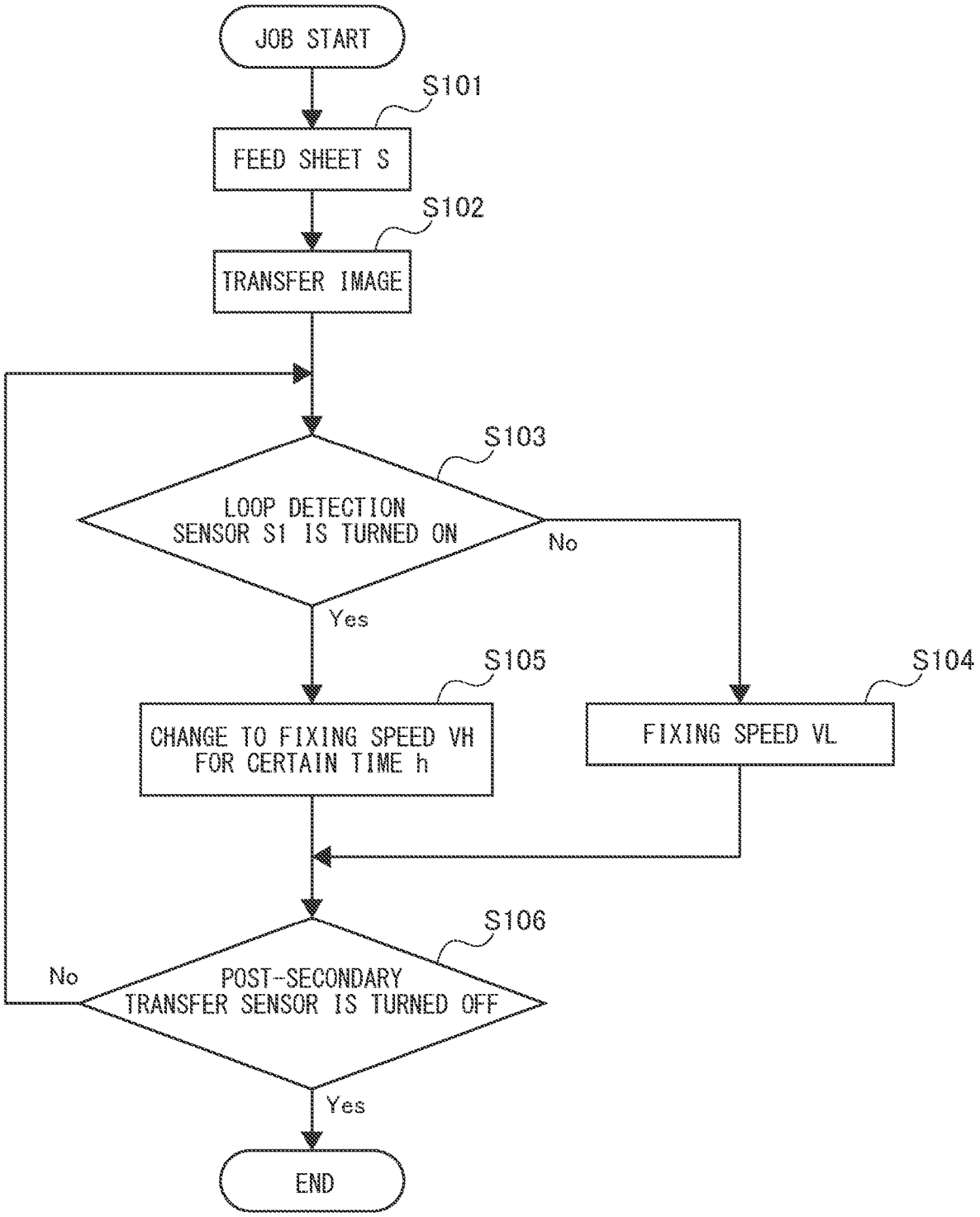
FIG. 7 is a flowchart of a loop detection operation of a sheet according to the embodiment.

Such loop control of the present embodiment will be specifically described with reference to a flowchart of FIG. 7. First, when a job is started, the sheet S is fed from the sheet storage cassette 11 and conveyed toward the registration roller 15 (S101). Next, an image is formed in each image forming unit in synchronization with feeding of the sheet, and the image is transferred to the sheet S conveyed from the registration roller 15 in the secondary transfer portion T2 (S102). The sheet S to which the image has been transferred is conveyed by the rotation of the secondary transfer portion T2 and the belt conveyance device 40, and reaches the fixing device 100.

At this time, the conveyance speed of the fixing device 100 (the sheet conveyance speed by the fixing belt 105 and the pressure belt 120) is set to VL (first speed) which is 2% slower than the sheet conveyance speed in the secondary transfer portion T2. As a result, as the sheet S is conveyed, a loop of the sheet is formed between the belt conveyance device 40 and the fixing nip portion N of the fixing device 100.

Then, the control unit 200 determines whether or not a loop is formed on the sheet from the situation of the loop detection unit 151 (S103). Specifically, it is determined whether the sheet S passes through the fixing nip portion N in a state where the output of the loop detection sensor S1 is off, that is, in a state where the sheet S does not form a loop, or whether the sheet S passes through the fixing nip portion N in a state where the sheet S forms a loop between the belt conveyance device 40 and the fixing nip portion N (the output of the loop detection sensor S1 is on).

When the sheet S passes through the fixing nip portion N without forming a loop (No in S103), the rotation of the motor 212 is controlled to set the conveyance speed of the fixing device 100 to VL (first speed) (S104). That is, when the sheet conveyance speed of the fixing device is VL, this VL is maintained, and when the sheet conveyance speed of the fixing device is VH to be described below, the sheet conveyance speed of the fixing device is reduced from VH to VL.

On the other hand, in a case where a loop is formed on the sheet in S103 (Yes in S103), the rotation of the motor 212 is controlled for a certain period of time h in order to set the conveyance speed of the fixing device 100 to VH (second speed) which is 2% faster than the sheet conveyance speed in the secondary transfer portion T2 (S105). That is, the sheet S is conveyed for the certain period of time h (0.5 seconds in the present embodiment) in a state where the sheet conveyance speed of the fixing device 100 is VH, and the loop of the sheet is eliminated. Thereafter, the control of S103 to S105 is repeated until it is detected by the post-secondary transfer sensor 220 (see FIG. 1) provided downstream of the secondary transfer portion T2 that the trailing edge of the sheet S has passed through the secondary transfer portion T2 (S106). Note that the loop detection sensor may determine that the sensor signal is in the loop state when the on state of the sensor signal continues for a certain period of time (for example, 0.1 seconds) in order to prevent erroneous detection.

Residual Sheet Detection Control

Next, residual sheet detection control of detecting a sheet remaining in the fixing nip portion N using the residual sheet detection unit 152 described above and notifying an error will be described. In a case where the residual sheet detection unit 152 detects a sheet when the power of the apparatus is turned on, the control unit 200 outputs information indicating that a sheet remains in the fixing device 100. That is, in a case where the residual sheet detection sensor S2 is turned on when the power of the image forming apparatus 1 is turned on, the control unit 200 displays an error notification indicating that a sheet remains in the fixing device 100 on an operation panel B. Note that the control unit 200 may output the error notification to an external terminal such as a personal computer connected to the image forming apparatus 1.

Figure 8:
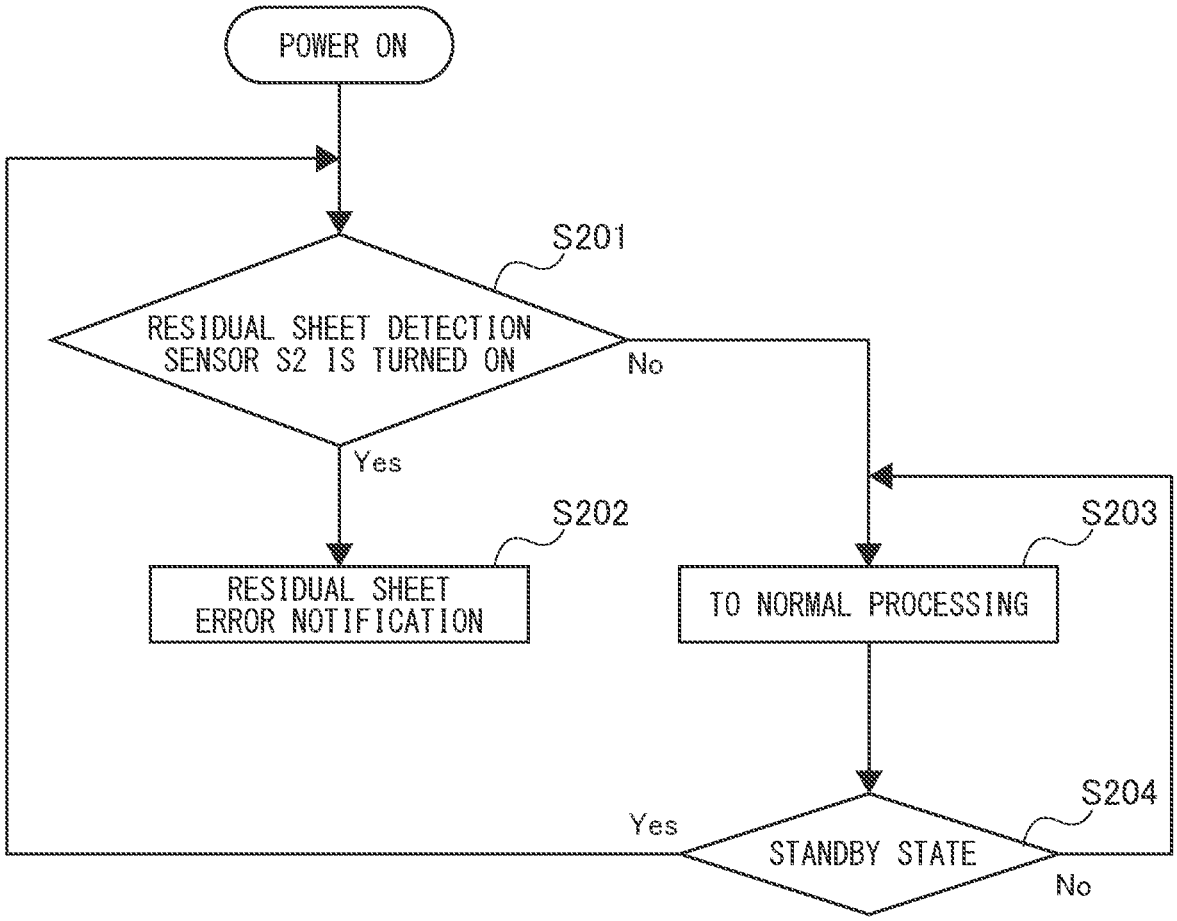
FIG. 8 is a flowchart of a sheet residual detection operation according to the embodiment.

Such residual sheet detection control of the present embodiment will be specifically described with reference to a flowchart of FIG. 8. FIG. 8 is a flowchart for explaining a process of detecting remaining of the sheet S in a power-on state of the image forming apparatus 1 and in an idle state in which a print job is not executed. When the image forming apparatus 1 is powered on, the control unit 200 checks whether the residual sheet detection sensor S2 is in the turn-on state, that is, whether the sheet S is detected (S201). In the turn-on state (Yes in S201), the control unit 200 determines that there is a residual sheet in the fixing device 100, and notifies the user of an error indicating that there is a residual sheet (S202).

On the other hand, when the residual sheet detection sensor S2 does not detect the sheet S when the power is turned on in S201 (No in S201), the processing proceeds to normal initialization processing, image forming job reception, and image forming job execution processing (S203). Note that the image forming job is an operation from the start of image formation to the completion of image formation based on a print signal (image forming signal) for forming an image on a sheet. The initialization processing is processing of starting rotation of the photosensitive drum, sequentially raising various voltages, adjusting various voltages, and the like as a preparation operation before the image forming operation, and is so-called pre-rotation processing.

Next, the control unit 200 determines whether an image forming job not being executed is in a standby state (S204). If it is in the standby state (Yes in S204), the process proceeds to S201, and the control unit 200 determines whether to notify the user of the jam error by determining that there is a residual sheet similarly to when the power is turned on. When the process is not in the standby state in S204 (No in S204), the process returns to S203 to continue the normal processing. Accordingly, it is possible to determine whether the sheet S remains in a state where the sheet S is not conveyed.

In such a case of the present embodiment, the detection accuracy of each of the loop detection and the residual sheet detection can be improved. That is, since the residual sheet detection flag 152*a* comes into contact with the sheet at a position closer to the inlet of the fixing nip portion N than the loop detection flag 151*a*, the residual sheet detection can be performed even for a small-sized sheet. In addition, since the loop detection flag 151*a* and the residual sheet detection flag 152*a* are biased by the rotational spring 154 which is a common biasing unit, the biasing force with respect to the sheet can be made smaller than a case where each is biased by the spring. Therefore, even when the stiffness of the sheet is low, deformation of the sheet can be suppressed. In addition, even when the weight of the sheet is small, it is possible to suppress the loop detection flag 151*a* and the residual sheet detection flag 152*a* from being pressed by the sheet and being difficult to move, and the detection by the sensor can be performed more reliably.

In the case of the present embodiment, by providing the loop detection unit 151 and the residual sheet detection unit 152 in the fixing inlet guide 150, it is possible to detect the residual of the sheet at a position close to the fixing nip portion N and to detect the loop at a position where the loop change amount on the upstream in the sheet conveyance direction is larger than the residual sheet detection position.

In addition, the loop detection flag 151*a* is provided with the rotational spring 154, the loop detection flag 151*a* and the residual sheet detection flag 152*a* are arranged so as to be rotatable about the same rotation shaft 153, and a region where the engagement protrusion portion 151*c* and the engagement recess portion 152*c* are not engaged is provided, so that each of the loop detection flag 151*a* and the residual sheet detection flag 152*a* can be independently rotated in a predetermined rotation range without providing a plurality of rotational springs.

In addition, in a case where the conveyance locus of the sheet conveyed by the belt conveyance device 40 is extended, it is preferable to incline the direction of conveying the sheet in the fixing nip portion N with respect to an imaginary line extending the sheet conveyance locus such that the outlet of the fixing nip portion N is farther from the imaginary line than the inlet of the fixing nip portion N. As a result, the sheet remaining in the fixing nip portion N is held in the fixing nip portion N such that the residual sheet detection flag 152*a* is inclined downward, so that the residual sheet detection flag 152*a* facilitates detection of the residual sheet.

Other Embodiments

In the above-described embodiment, the first contact portion and the second contact portion of the loop detection unit 151 and the residual sheet detection unit 152 are set as the loop detection flag 151*a* and the residual sheet detection flag 152*a* that rotate. However, the first contact portion and the second contact portion may slide by coming into contact with the sheet in addition to rotating. For example, the first contact portion and the second contact portion are arranged so as to be movable in the vertical direction of FIGS. 4A to 5B, and the first contact portion and the second contact portion are biased upward by a common biasing unit, for example, a spring.

In addition, in the above-described embodiment, the intermediate transfer method of transferring a toner image from the intermediate transfer belt 26 serving as an image bearing member to a sheet has been described, but the present invention is also applicable to a direct transfer method of directly transferring a toner image from a photosensitive drum to a sheet. In this case, the photosensitive drum corresponds to the image bearing member.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-184629, filed Nov. 12, 2021, which is hereby incorporated by reference herein in its entirety.

What is claimed is:

1. An image forming apparatus comprising:

a transfer portion configured to transfer a toner image onto a recording material;

a first rotary member configured to rotate and include a heat source;

a second rotary member configured to form a nip portion by being in contact with an outer peripheral surface of the first rotary member, and fix a toner image by applying heat and pressure while nipping and conveying a recording material together with the first rotary member;

a loop detection unit configured to detect that a recording material is looped between the nip portion and the transfer portion in a conveyance direction of the recording material, the loop detection unit including a first contact portion in contact with a back surface of the recording material to which a toner image has been transferred by the transfer portion where a surface of the recording material in contact with the first rotary member is referred to as a front surface and a surface of the recording material in contact with the second rotary member is referred to as the back surface when the recording material is nipped and conveyed by the nip portion; and a residual sheet detection unit configured to detect that the recording material remains in the nip portion between the nip portion and the transfer portion in the conveyance direction, the residual sheet detection unit including a second contact portion that is configured to come into contact with the back surface of the recording material to which the toner image has been transferred in the transfer portion, wherein the first contact portion and the second contact portion are configured to rotate on the same rotation shaft, and the second contact portion is configured to come into contact with the back surface of the recording material on a downstream of the first contact portion in the conveyance direction.

2. The image forming apparatus according to claim 1, wherein the residual sheet detection unit is configured to detect that the recording material remains in the nip portion in a case where a jam occurs and the second contact portion comes into contact with the back surface.

3. The image forming apparatus according to claim 2, wherein the loop detection unit is configured to detect that the recording material forms a loop in a case where the first contact portion comes into contact with the back surface during image formation.

4. The image forming apparatus according to claim 3, wherein the residual sheet detection unit includes a first sensor configured to detect that the recording material remains in the nip portion; and the loop detection unit includes a second sensor configured to detect a loop of the recording material.

5. The image forming apparatus according to claim 4, further comprising a control unit configured to control a rotational speed of the second rotary member, wherein the control unit is configured to set the rotational speed of the second rotary member to a first speed in a case where the second sensor does not detect a loop of the recording material during conveyance of the recording material, and set the rotational speed of the second rotary member to a second speed higher than the first speed in a case where the second sensor detects a loop of the recording material.

6. The image forming apparatus according to claim 1, further comprising an inlet guide configured to guide the recording material conveyed from the transfer portion to an inlet of the nip portion, wherein the residual sheet detection unit and the loop detection unit are provided in the inlet guide.

7. The image forming apparatus according to claim 1, further comprising a conveyance unit configured to convey the recording material between the transfer portion and the nip portion, wherein a direction in which the recording material is conveyed in the nip portion is inclined with respect to an imaginary line such that an outlet of the nip portion is farther from the imaginary line than an inlet of the nip portion in a case where the imaginary line is a line extending a conveyance locus of the recording material being conveyed by the conveyance unit.

* * * * *